US010202880B2

(12) United States Patent
Kuroyanagi et al.

(10) Patent No.: US 10,202,880 B2
(45) Date of Patent: Feb. 12, 2019

(54) EXHAUST HEAT EXCHANGER

(71) Applicant: DENSO CORPORATION, Kariya, Aichi-pref. (JP)

(72) Inventors: Isao Kuroyanagi, Kariya (JP); Ryoichi Sanada, Kariya (JP); Yasutoshi Yamanaka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 41 days.

(21) Appl. No.: 15/300,632

(22) PCT Filed: Apr. 20, 2015

(86) PCT No.: PCT/JP2015/002139
§ 371 (c)(1),
(2) Date: Sep. 29, 2016

(87) PCT Pub. No.: WO2015/162897
PCT Pub. Date: Oct. 29, 2015

(65) Prior Publication Data

US 2017/0107883 A1 Apr. 20, 2017

(30) Foreign Application Priority Data

Apr. 21, 2014 (JP) ..... 2014-087237

(51) Int. Cl.
*F01N 3/00* (2006.01)
*F01N 5/02* (2006.01)
(Continued)

(52) U.S. Cl.
CPC ..... *F01N 5/02* (2013.01); *F28D 7/1684* (2013.01); *F28D 9/0031* (2013.01); *F28F 1/02* (2013.01);
(Continued)

(58) Field of Classification Search
CPC .. F28F 13/02; F28F 13/08; F28F 13/12; F28F 1/40; F28F 2215/10; F28F 3/025;
(Continued)

(56) References Cited

U.S. PATENT DOCUMENTS 8,424,592 B2 * 4/2013 Meshenky ..... B21D 13/08 165/151
2010/0024508 A1 2/2010 Opferkuch et al.
2010/0095659 A1 4/2010 Kuroyanagi et al.

FOREIGN PATENT DOCUMENTS

JP H01098896 A 4/1989
JP 2010096456 A 4/2010

* cited by examiner

*Primary Examiner* — Audrey K Bradley
*Assistant Examiner* — Anthony Ayala Delgado
(74) *Attorney, Agent, or Firm* — Harness, Dickey & Pierce, P.L.C.

(57) ABSTRACT

An exhaust heat exchanger has a fin disposed in an exhaust passage in which exhaust air flows in a flow direction and having plate portions. The plate portions respectively have a protruding portion that protrudes from the plate portions. When a direction perpendicular to both the flow direction and a direction perpendicular to the flow direction is defined as a fin height direction, (i) a protruding amount of the protruding portion in a second site is larger than that in a first site, to which the second site is located on a downstream side of the first site in the flow direction, and (ii) a protruding amount of the protruding portion in a third site is larger than that in a fourth site, to which the fourth site is located away from a center portion of the protruding portion than the third site in the fin height direction.

6 Claims, 11 Drawing Sheets

(51) Int. Cl.

| | |
|---|---|
| ***F28F 1/40*** | (2006.01) |
| ***F28F 13/12*** | (2006.01) |
| ***F28F 1/02*** | (2006.01) |
| ***F28F 3/02*** | (2006.01) |
| ***F28D 7/16*** | (2006.01) |
| ***F28D 9/00*** | (2006.01) |
| ***F28F 1/04*** | (2006.01) |

(52) U.S. Cl.
CPC ..... *F28F 1/04* (2013.01); *F28F 1/40* (2013.01); *F28F 3/027* (2013.01); *F28F 13/12* (2013.01)

(58) Field of Classification Search
CPC ..... F28F 3/027; F28F 2215/04; F28F 1/025; F28F 3/044
See application file for complete search history.

EXHAUST HEAT EXCHANGER

CROSS REFERENCE TO RELATED APPLICATIONS

This application is a U.S. National Phase Application under 35 U.S.C. 371 of International Application No. PCT/JP2015/002139 filed on Apr. 20, 2015 and published in Japanese as WO 2015/162897 A1 on Oct. 29, 2015. This application is based on and claims the benefit of priority from Japanese Patent Application No. 2014-087237 filed on Apr. 21, 2014. The entire disclosures of all of the above applications are incorporated herein by reference.

TECHNICAL FIELD

The present disclosure relates to an exhaust heat exchanger that cools exhaust air generated by combustion, and the exhaust heat exchanger cools the exhaust air performing a heat exchange between the exhaust heat and a cooling medium.

BACKGROUND ART

Conventionally, an exhaust heat exchanger in which an offset fin having a corrugated shape is disposed in an exhaust passage in which exhaust air from an internal combustion engine flows, and the offset fin has a top surface provided with a protruding portion that protrudes inward from the top surface is provided. According to the exhaust heat exchanger, it is attempted to suppress a deposit of an uncombusted material by increasing a turbulent blow generation effect in the offset fin providing the protruding portion.

PRIOR ART LITERATURES

Patent Literature

Patent Literature 1: JP 2010-96456 A

SUMMARY OF INVENTION

However, according to experiments by the inventors of the present disclosure, a fin pitch is required to be large since the top surface of the fin has the protruding portion in the exhaust heat exchanger disclosed in Patent Literature 1. As a result, a heat exchange performance may deteriorate.

The present disclosure addresses the above issue, and thus it is an objective of the present disclosure to provide an exhaust heat exchanger with which a heat exchange performance can be secured, and a deposit of uncombusted material can be suppressed.

According to a first aspect of the present disclosure, an exhaust heat exchanger has an exhaust passage in which exhaust air exhausted from an internal combustion engine flows in a flow direction from an upstream side to a downstream side. The exhaust heat exchanger performs a heat exchange between the exhaust air and a cooling medium flowing outside of the exhaust passage. The exhaust heat exchanger has a fin that is disposed in the exhaust passage and has plate portions. The plate portions are arranged in the flow direction and in a direction perpendicular to the flow direction, and adjacent two of the plate portions that are adjacent to each other in the flow direction are misaligned from each other in the direction perpendicular to the flow direction. The plate portions respectively have a protruding portion that protrudes from the plate portions in the direction perpendicular to the flow direction. In the exhaust passage, (i) a protruding amount of the protruding portion in a second site from the plate portions is larger than a protruding amount of the protruding portion in a first site from the plate portions, and (ii) a protruding amount of the protruding portion in a third site from the plate portions is larger than a protruding amount of the protruding portion in a fourth site from the plate portions, to which a direction perpendicular to both the flow direction and the direction perpendicular to the flow direction is defined as the fin height direction, a site of the protruding portion located on a downstream side of the first site of the protruding portion in the flow direction is defined as the second site, and a site of the protruding portion located away from a center portion of the protruding portion than the third site of the protruding portion in the fin height direction is defines as the fourth site.

According to the above-described configuration, there is no necessity to increase the fin pitch by providing the protruding portion in the plate portions. The heat exchange performance thereby can be secured.

Furthermore, according to the exhaust heat exchanger of the first aspect, (i) the protruding amount of the protruding portion in the second site from the plate portions is larger than the protruding amount of the protruding portion in the first site from the plate portions, and (ii) the protruding amount of the protruding portion in the third site from the plate portions is larger than the protruding amount of the protruding portion in the fourth site from the plate portions. As a result, in the exhaust passage, a main flow of exhaust air flowing at a high speed is guided along a wall surface of the protruding portion to a site adjacent to a wall surface of the exhaust passage along which exhaust air flows at a low speed. A flow speed of the exhaust air flowing in the site adjacent to the wall surface of the exhaust passage therefore becomes high, and the deposit of the uncombusted material in the site adjacent to the wall surface can be suppressed.

Moreover, a swirl flow flowing from a downstream end of the protruding portion toward a downstream side in the flowing direction is caused in the exhaust air flowing in the exhaust passage by configuring the protruding portion as described above. As a result, both of suppressing the deposit in the site adjacent to the wall portion of the exhaust passage on the downstream side of the protruding portion in the flow direction and suppressing the deposit on an upstream side of the plate portions located on the downstream side of the protruding portion can be achieved.

Alternatively, according to a second aspect of the present disclosure, an exhaust heat exchanger has an exhaust passage in which exhaust air exhausted from an internal combustion engine flows in a flow direction from an upstream side to a downstream side. The exhaust heat exchanger performs a heat exchange between the exhaust air and a cooling medium flowing outside of the exhaust passage. The exhaust heat exchanger has a fin that is disposed in the exhaust passage and has plate portions. The plate portions are arranged in the flow direction and in a direction perpendicular to the flow direction, and adjacent two of the plate portions that are adjacent to each other in the flow direction are misaligned from each other in the direction perpendicular to the flow direction. The plate portions respectively have a protruding portion that protrudes from the plate portions in the direction perpendicular to the flow direction. According to the second aspect of the present disclosure, a protruding amount of the protruding portion from the plate portions may increase from the upstream side toward the downstream side in the flow direction and increase toward the center portion of the protruding portion in a fin height direction, to which a direction perpendicular to both the flow direction and the direction perpendicular to the flow direction is defined as the fin height direction. According to a configuration of the second aspect, the deposit of the uncombusted material can be suppressed while a heat exchange performance is being secured similar to the first aspect.

The protruding portion is not limited to have a protruding amount of the protruding portion from the plate portions increasing from the upstream side toward the downstream side in the flow direction and increasing toward the center portion of the protruding portion in a fin height direction. That is, the protruding portion, as a whole, is only required to have a protruding amount from the plate portions increasing from the upstream side to the downstream side in the flow direction and increasing toward the center portion of the protruding portion in the fin height direction. In other words, the protruding amount from the plate members may be partially fixed or decreased from the upstream side to the downstream side in the flow direction with in a range in which the protruding portion functions well. Alternatively, the protruding amount from the plate members may be partially fixed or decreased toward the center portion of the protruding portion in the fin height direction in a range in which the protruding portion functions well.

DESCRIPTION OF EMBODIMENTS

Embodiments of the present disclosure will be described hereafter referring to drawings. In the embodiments, a part that corresponds to or equivalents to a matter described in a preceding embodiment may be assigned with the same reference number.

First Embodiment

A first embodiment will be described hereafter referring to FIG. 1 through FIG. 6. According to the present embodiment, an example in which an exhaust heat exchanger of the present disclosure is used for an EGR cooler. The EGR cooler is an exhaust heat exchanger that cools exhaust air using an engine cooling water (i.e., a cooling medium) when recirculating the exhaust heat generated in an engine (i.e., an internal combustion engine) by a combustion to the engine.

Figure 1:
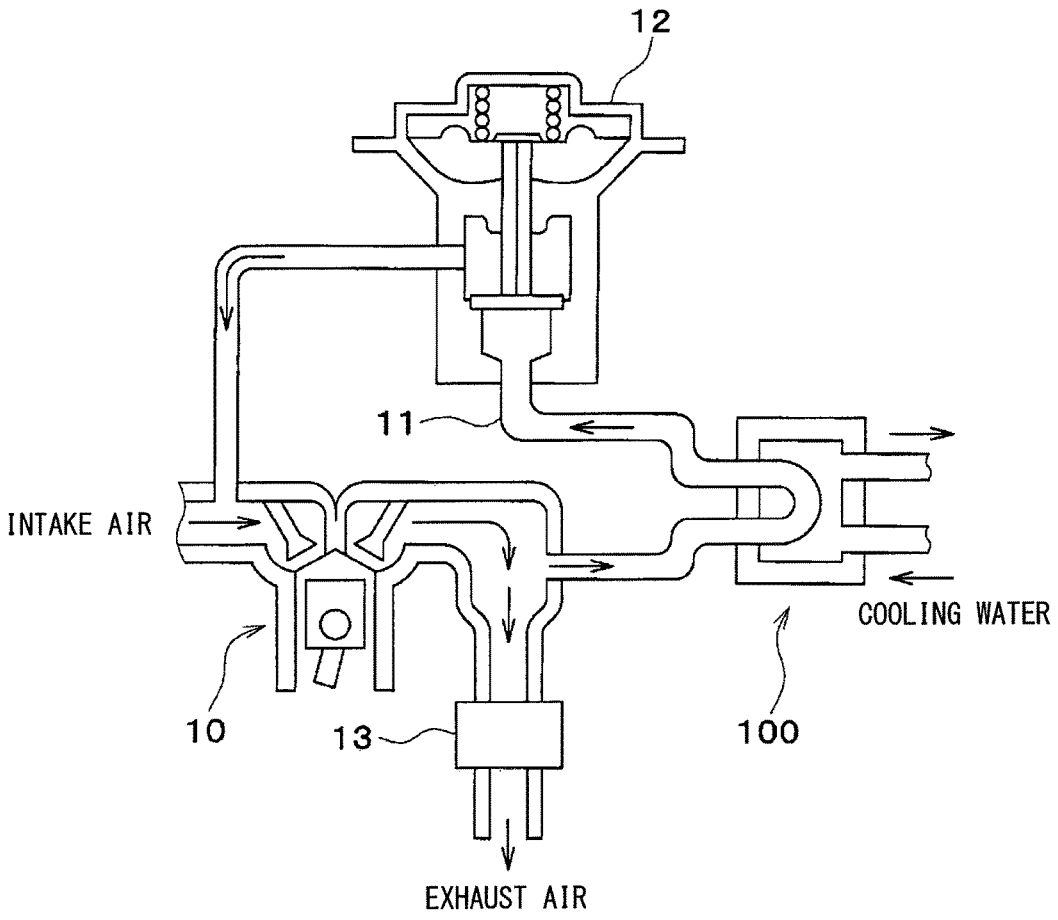
FIG. 1 is a schematic diagram illustrating an EGR using an EGR cooler according to a first embodiment.

As shown in FIG. 1, an exhaust gas recirculation (EGR) device is a device that is disposed in the engine for a vehicle to reduce a quantity of nitrogen oxide in the exhaust gas. The EGR device has an EGR pipe 11, an EGR valve 12, and an EGR cooler 100. The EGR pipe 11 is a pipe that circulates a part of exhaust air exhausted from the engine 10 toward a suction side of the engine 10. An inlet of the EGR pipe 11 is connected to an upstream side of an exhaust purification catalyst 13 in a flow direction of the exhaust air.

The EGR valve 12 is arranged in the EGR pipe 11 and adjusts a volume of the exhaust air (that will be referred to as EGR gas hereafter) flowing in the EGR pipe 11 depending on an operation state of the engine 10. The EGR cooler 100 is a heat exchanger that performs a heat exchange between the EGR gas and the cooling water for the engine 10 and cools the EGR gas. The EGR cooler 100 is arranged between the suction side of the engine 10 and the EGR valve 12.

Figure 2:
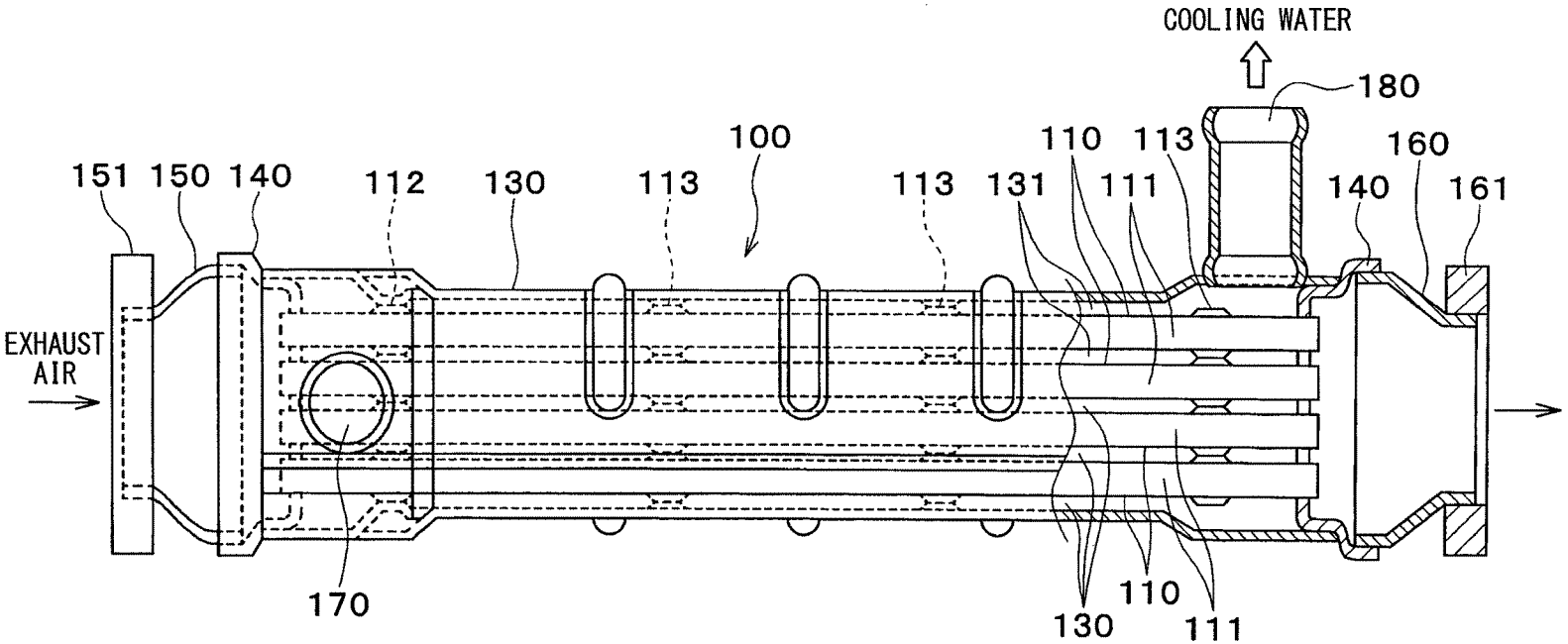
FIG. 2 is a front view illustrating the EGR cooler according to the first embodiment.
Figure 3:
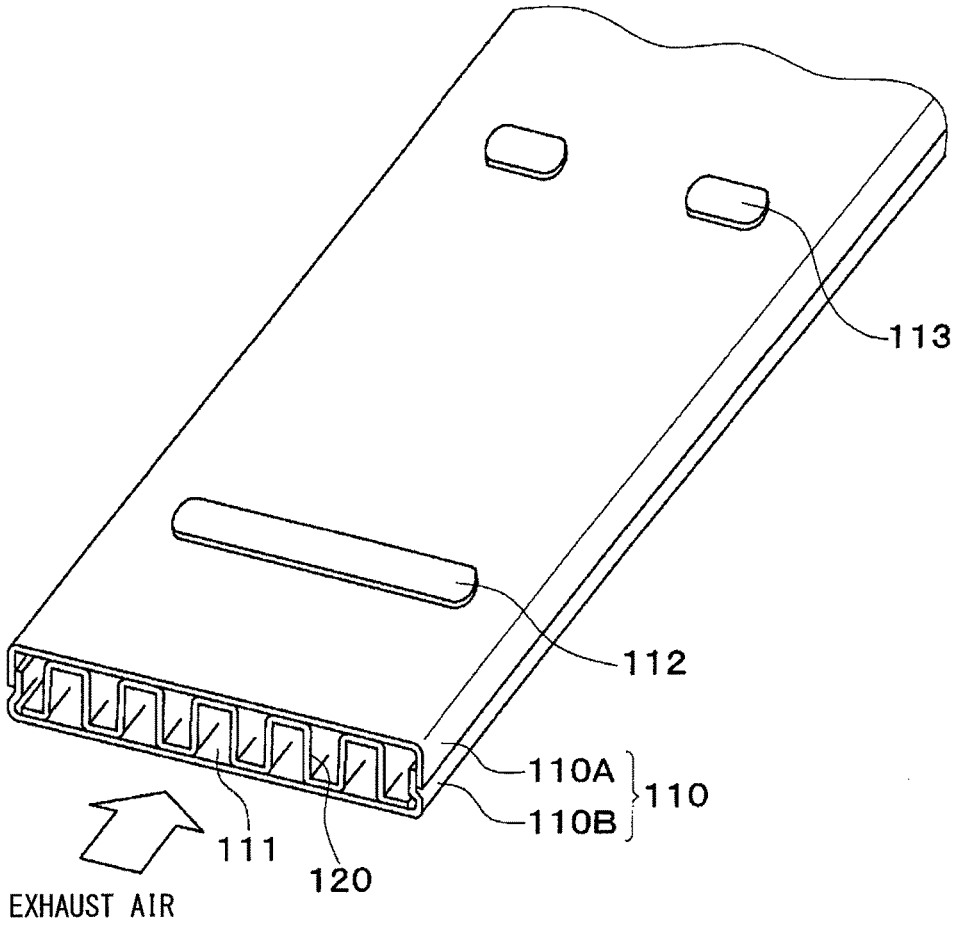
FIG. 3 is a perspective view illustrating a tube according to the first embodiment.

A configuration of the EGR cooler 100 will be described referring to FIG. 2 and FIG. 3. The EGR cooler 100 has a tube 110, a fin 120, a casing 130, a core plate 140, and tanks 150, 160, an inlet 170, and an outlet 180 as shown in FIG. 2. Each of the above-listed members is made of a stainless material having great thermal resistance and great corrosion resistance. The above-listed members respectively have a site in which the member is in contact with another member, and the member and another member are coupled with each other in the site by brazing.

The tube 110 is a pipe member that therein provides an exhaust passage 111 in which the EGR gas flows from an upstream side to a downstream side in the flow direction. The tube 110 is formed to have a rectangular flat shape in cross section that intersects with the flow direction. The tube 110 is configured by two tube plates 110A, 1108 that are formed by press molding to have a generally shallow U-shape in cross section, and opening ends of the tube plates 110A, 1108 having the U-shape are coupled with each other. The tube 110 has a surface (that will be referred to as an opposed surface) on a longitudinal side when viewed in cross section of the flat shape, and more than one of the tube 110 are stacked such that the opposed surfaces of adjacent two of the tubes 110 face each other.

The opposed surface of the tube 110 is provided with a first protruding portion 112 and a second protruding portion 113 that protrude outward. The first protruding portion 112 and the second protruding portion 113 are formed at the same time of press molding for the tube plates 110A, 1108.

The first protruding portion 112 is located on a side adjacent to an inlet of the EGR gas in a longitudinal direction of the tube 110 and located adjacent to a downstream portion of the inlet 170 of the cooling water. The first protruding portion 112 is formed in the opposed surface of the tube 110 to extend in a direction intersecting with the flow direction. The first protruding portion 112 has a longitudinal end that is located a specified distance away from a surface of the tube 110 located on a short side when viewed in the cross section of the flat shape. The first protruding portion 112 partitions an area around the inlet 170 into relatively small spaces, and thereby a flow speed of the cooling water flowing around the inlet for the EGR gas increases when the cooling water flows in.

On a downstream side of the first protruding portion 112 in the flow direction, more than one of the second protruding portion 113 are arranged to be specified distance away from each other. Specifically, two or more pair of the second protruding portions 113 is arranged. The second protruding portion 113 is formed to have a shape such as an ellipse shape. Top portions of opposed two of the first protruding portions 112 are in contact and connected to each other, and top portions of opposed two of the second protruding portions 113 are in contact and connected to each other, in the stacked tubes 110, and thereby a dimension between adjacent two of the tubes 110 are secured properly.

The fin 120 is a heat transfer member promoting a heat exchange between the EGR gas and the cooling water, and is arranged in the tube 110, in other words, in the exhaust passage 111. A configuration of the fin 120 will be described in detail.

The casing 130 therein houses a stacked body of the tubes 110 as shown in FIG. 2. The stacked body is configured in a manner that the tubes 110 are stacked and opposed two of the first protruding portions 112 and opposed two of the second protruding portions 113 are connected to each other respectively. The casing 130 is a case body having a square pipe shape and provides a cooling water passage 131 around the tubes 110 in the stacked body, and the cooling water flows in the casing 130. The cooling water passage 131 is provided between adjacent two of the tubes 110 and between the tube 110 and the casing 130.

The core plate 140 is formed to have a shallow bowl shape. A pair of the core plates 140 is provided by a pair of plate members, and each of the pair of plate members has tube holes drilled in a bottom surface. Both longitudinal end portions of the tube 110 are inserted to the tube holes of the pair of core plates 140 and coupled with the pair of core plates 140. As a result, the tubes 110 are supported by the pair of core plates 140. The pair of core plates 140 is connected to an inner surface of opening end portions of the casing 130 in the longitudinal direction respectively. The cooling water passage 131 in the casing 130 and an interior space of the tanks 150, 160 (described after) are partitioned by the pair of core plates 140.

An inlet side tank 150 is a member having a funnel shape and distributing the EGR gas to the tubes 110. The inlet side tank 150 has a larger end of which opening area is larger than an opening area of the other end, and the larger end is connected to an opening of the casing 130 on one side (i.e., a left side in FIG. 2) of the casing 130 in the longitudinal direction. Specifically, the larger end is connected to an inner surface of an opening portion of the core plate 140. The other end of the inlet tank 150 having an opening area that is smaller than the opening area of the larger end is connected to a joint part 151 for connecting to a halfway portion of the EGR pipe 11.

An outlet side tank 160 is a member having a funnel shape and collecting the EGR gas flowing out of the tubes 110. The outlet side tank 160 has a larger end of which opening area is larger than an opening area of the other end, and the larger end is connected to an opening of the casing 130 on the other side (i.e., a right side in FIG. 2) of the casing 130 in the longitudinal direction. Specifically, the larger end is connected to an inner surface of an opening portion of the core plate 140. The other end of the outlet tank 160 having an opening area that is smaller than the opening area of the larger end is connected to a joint part 161 for connecting to a halfway portion of the EGR pipe 11.

The inlet 170 is a pipe member guiding the cooling water into the cooling water passage 131. The inlet 170 is connected to an EGR gas inlet of the casing 130 such that an inside of the inlet 170 and an inside (i.e., the cooling water passage 131) of the casing 130 communicate with each other. An axial direction of the inlet 170 extends along the opposed surfaces of the stacked tubes 110.

The outlet 180 is a pipe member guiding the cooling water after passing through the cooling water passage 131 to an outside. The outlet 180 is connected to an EGR gas outlet of the casing 130 such that an inside of the outlet 180 and the inside (i.e., the cooling water passage 131) of the casing 130 communicate with each other. An axial direction of the outlet 180 extends perpendicular to the opposed surfaces of the stacked tubes 110.

Figure 4:
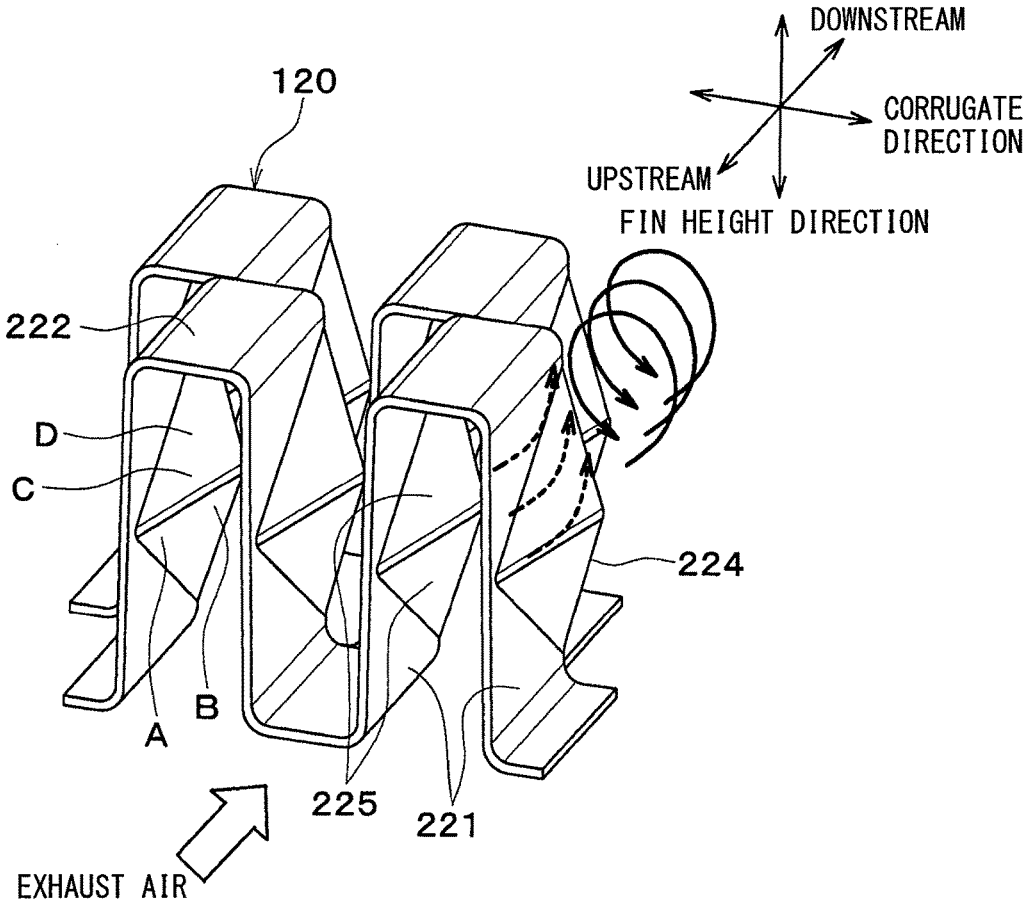
FIG. 4 is a perspective view illustrating a fin according to the first embodiment.
Figure 5:
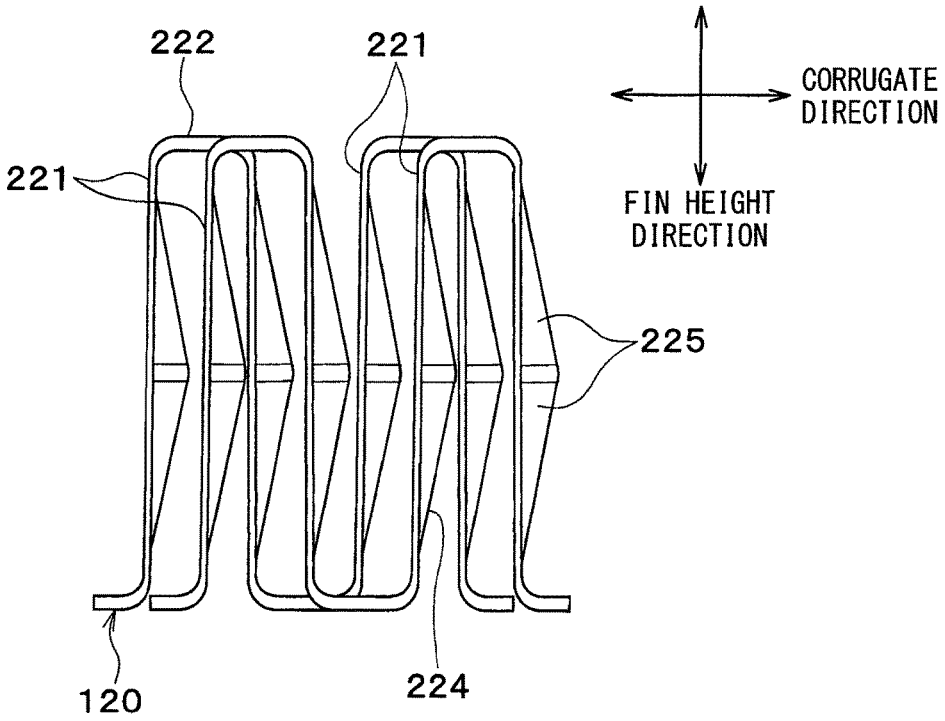
FIG. 5 is a front view illustrating the fin when viewed in a flow direction of exhaust air according to the first embodiment.

A configuration of the fin 120 according to the present embodiment will be described in detail hereafter referring to FIG. 4 through FIG. 6. As shown in FIG. 4 and FIG. 5, the fin 120 has segments (i.e., plate portions) 221 and top surface 222 connecting the segments 221 to each other. The fin 120 is formed to have a corrugate shape (e.g., a rectangular corrugate shape) in cross section when viewed in the flowing direction.

Each of the segments 221 is a member corresponding to a vertical wall of the fin 120 having a corrugate shape and connects adjacent two inner surfaces of the exhaust tube 21 with each other. The top surface 222 is a wall surface corresponding to a top portion or a bottom portion of the fin 120 and in contact with and connected to the inner surfaces of the exhaust tube 21.

The segments 221 are provided to be arranged in the flow direction and in a direction (i.e., a corrugate direction) perpendicular to the flow direction. The fin 120 thereby has a corrugate shape in cross section when viewed in the flow direction. Adjacent two of the segments 221 adjacent to each other in the flow direction are offset from each other in the direction perpendicular to the flow direction. That is, the fin 120 configures an offset inner fin. Specifically, as shown in FIG. 6, the segments 221 are arranged to be staggered (i.e., alternate) in the flow direction.

Each of the segments 221 has a protruding portion 224 that protrudes from the segment 221 in the corrugate direction. According to the present embodiment, the protruding portion 224 is formed by pressing a part of the segment 221 to deform plastically. All of the protruding portions 224 provided in the segments 221 respectively protrude in the same direction, in other words, the same direction with respect to the segments 221.

In the exhaust passage 111, a direction perpendicular to both the flow direction and the direction perpendicular to the flow direction is defined as a fin height direction.

As shown in FIG. 4, the protruding portion 224 has an arbitrary site referred to as a first site (e.g., a site assigned with A in FIG. 4) and a second site (e.g., a site assigned with B in FIG. 4) located on a downstream side of the first site. A protruding amount of the protruding portion 224 from the segment 221 in the second site B is larger than a protruding amount of the protruding portion 224 from the segment 221 in the first site A. Further, the protruding portion 224 has an arbitrary site referred to as a third site (e.g., a site assigned with C in FIG. 4) and a fourth site (e.g., a site assigned with D in FIG. 4) located away from a center portion of the protruding portion 224 in the fin height direction than the third site. A protruding amount of the protruding portion 224 from the segment 221 in the third site C is larger than a protruding amount of the protruding portion 224 from the segment 221 in the fourth site D.

According to the present embodiment, the protruding amount of the protruding portion 224 from the segment 221 increases from the upstream side toward the downstream side in the flow direction and increases toward the center portion of the protruding portion 224 in the fin height direction.

Specifically, the protruding portion 224 has a generally triangle shape in a planar view when viewed in the flow direction as shown in FIG. 5. That is, the protruding amount of the protruding portion 224 increases linearly toward the center portion of the protruding portion 224 in the fin height direction.

Figure 6:
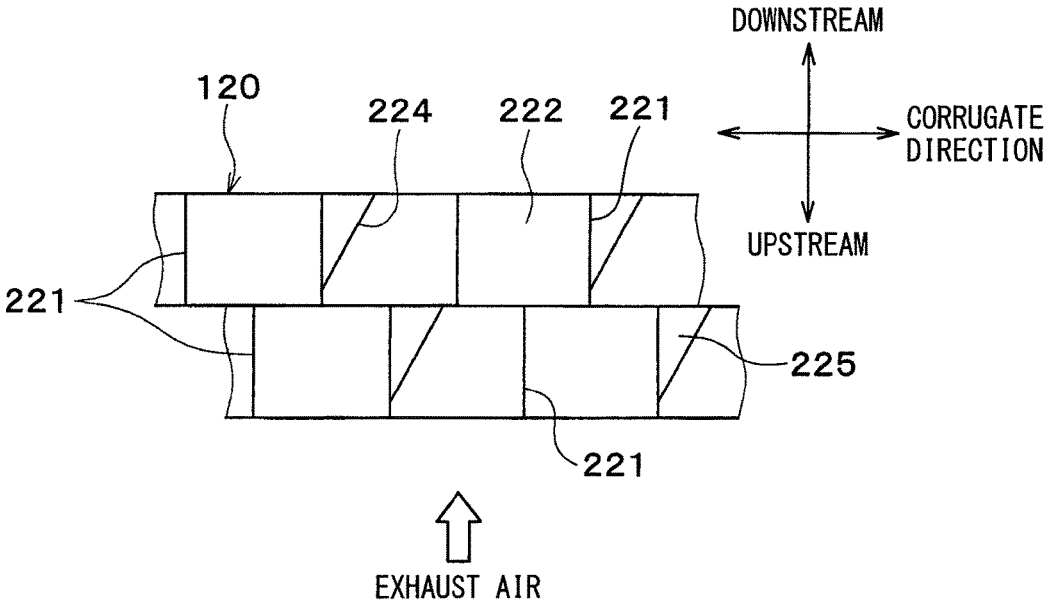
FIG. 6 is a planar view illustrating the fin when viewed in a fin height direction according to the first embodiment.

The protruding portion 224 has a generally triangle shape in a planar view, as shown in FIG. 6, when viewed in the fin height direction. That is, the protruding amount of the protruding portion 224 increases linearly from the upstream side toward the downstream side in the flow direction.

The protruding portion 224 has a generally triangle shape in the planar view, as shown in FIG. 4, when viewed in the corrugate direction of the fin 120. A length of the protruding portion in the fin height direction increases from the upstream side toward the downstream side in the flow direction in the planar view when viewed in the corrugate direction of the fin 120.

The protruding portion 224 has two inclined surfaces 225 respectively having a triangle shape. The two inclined surfaces 225 are connected to each other in the center portion of the protruding portion in the fin height direction. The center portion of the protruding portion 224 in the fin height direction is located in a center portion of the segment 221 in the fin height direction. A void is provided between an upstream end of the protruding portion 224 in the flow direction and an upstream periphery of the segment 221 in the flow direction. In other words, the upstream end of the protruding portion 224 in the flow direction is distanced from the upstream periphery of the segment 221 in the flow direction toward a downstream side in the flow direction.

As described above, according to the present embodiment, the segment 221 of the fin 120 has the protruding portion 224. Accordingly, a fin pitch is not necessary to be large, and thereby a heat exchange performance can be secured.

According to the present embodiment, the protruding amount of the protruding portion 224 from the segment 221 in the second site B is larger than the protruding amount of the protruding portion 224 from the segment 221 in the first site A. The protruding amount of the protruding portion 224 from the segment 221 in the third site C is larger than the protruding amount of the protruding portion 224 from the segment 221 in the fourth site D. That is, the protruding amount of the protruding portion 224 from the segment 221 increases from the upstream side toward the downstream side in the flow direction and increases toward the center portion of the protruding portion 224 in the fin height direction.

As a result, as shown by a dashed line in FIG. 4, a main flow of exhaust air flowing at a high speed in the exhaust passage 111 is guided along the inclined surface 225 of the protruding portion 224 to a site in the exhaust passage 111 adjacent to an inner wall surface (that will be referred to as a tube inner surface hereafter) of the tube 110 along which exhaust air flows at a low speed. A flow speed of the exhaust air flowing in the site in the exhaust passage 111 adjacent to the tube inner surface therefore increases, and the deposit of the uncombusted material in the site adjacent to the inner surface can be suppressed.

Moreover, as shown by a solid line in FIG. 4, a swirl flow flowing from a downstream end of the protruding portion 224 toward the downstream side in the flow direction is caused in the exhaust air flowing in the exhaust passage 111 by configuring the protruding portion 224 as described in the present embodiment. As a result, both of suppressing the deposit in the site adjacent to the tube inner surface of the exhaust passage 111 on the downstream side of the protruding portion 224 in the flow direction and suppressing the deposit on an upstream side of the segment 221 located on the downstream side of the protruding portion 224 can be achieved.

Second Embodiment

A second embodiment will be described hereafter referring to FIG. 7. The second embodiment is different from the first embodiment in a point that the protruding portion 224 is cut.

Figure 7:
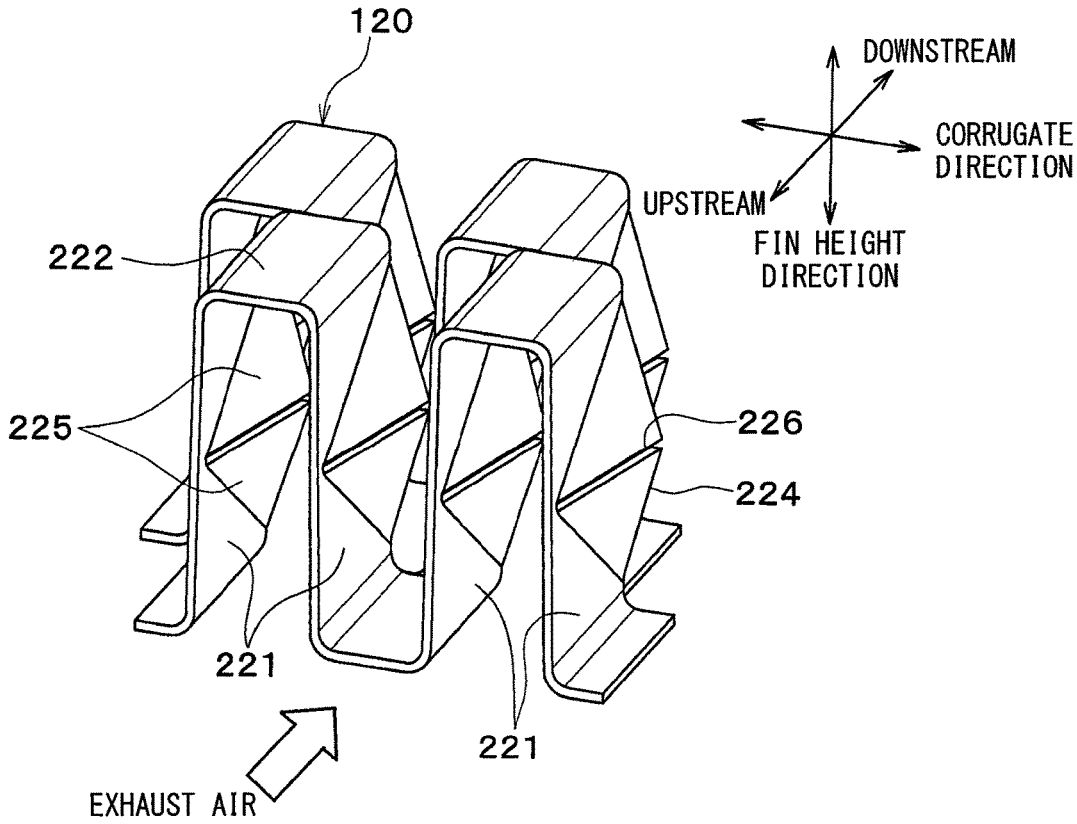
FIG. 7 is a perspective view illustrating a fin according to a second embodiment.

As shown in FIG. 7, the protruding portion 224 of the present embodiment is cut into two portions in the center portion in the fin height direction. That is, according to the present embodiment, the two inclined surfaces 225 of the protruding portion 224 are not connected to each other.

Specifically, the center portion of the protruding portion 224 in the fin height direction is cut from the downstream side toward the upstream side of the protruding portion 224 in the flow direction, and thereby a slit 226 is provided. The slit 226 extends parallel to the flow direction.

Other configurations are the same as the first embodiment. The exhaust heat exchanger of the present embodiment thus can provide the same effects as the first embodiment. Moreover, a moldability of the protruding portion 224 can be improved by cutting the protruding portion 224 into the two portions in the center portion of the protruding portion 224 in the fin height direction.

As described above, the upstream end of the protruding portion 224 in the flow direction and the upstream end surface of the segment 221 in the flow direction are distanced from each other. In other words, a flat portion is formed between the upstream end of the protruding portion 224 and the upstream end surface of the segment 221 in the flow direction. As a result, the fin 120 (i.e., the segment 221) itself is not decomposed by being cut when the protruding portion 224 has the slit 226.

Third Embodiment

A third embodiment will be described hereafter referring to FIG. 8. The third embodiment is different from the first embodiment in a point that the segment 221 of the fin 120 has more than one of the protruding portions 224.

Figure 8:
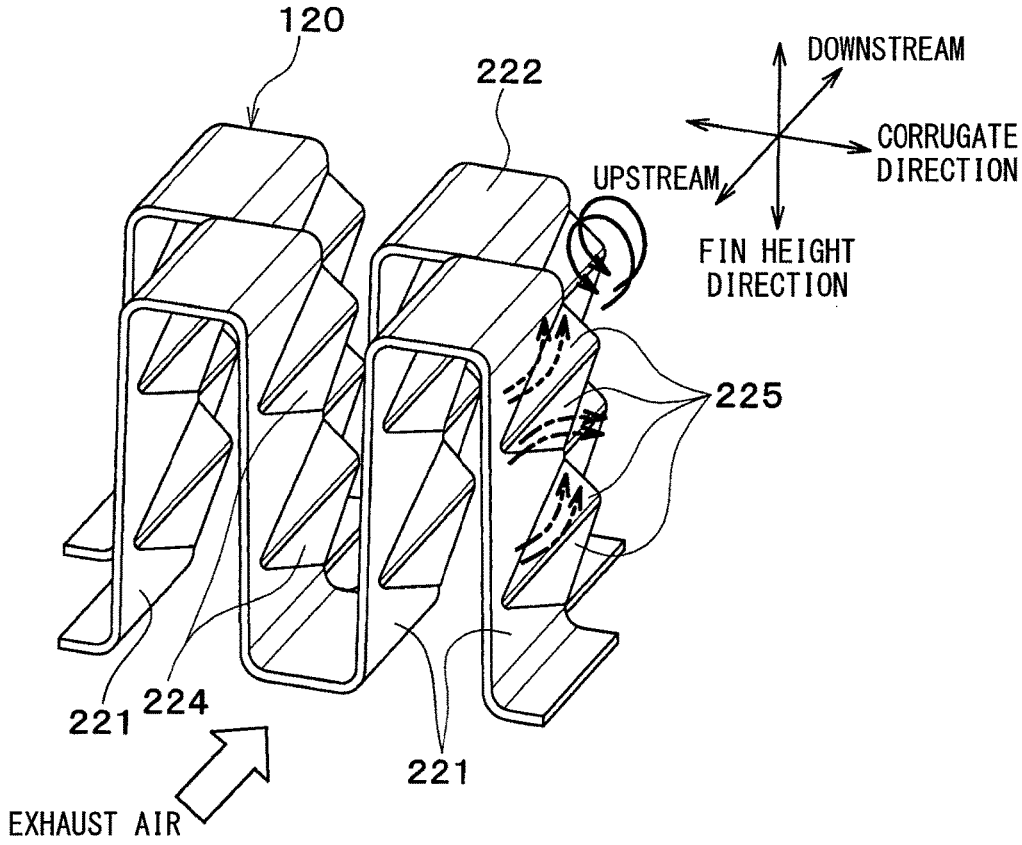
FIG. 8 is a perspective view illustrating a fin according to a third embodiment.

As shown in FIG. 8, the segment is provided with more than one (e.g., two according to the present embodiment) of the protruding portions 224. The protruding portions 224 are arranged in the fin height direction. According to the present embodiment, the protruding portions 224 protrude in the same direction.

According to the present embodiment, as shown by a dashed line in FIG. 8, a main flow of exhaust air flowing at a high speed in the exhaust passage 111 is guided along the inclined surface 225 of the protruding portion 224 located on an outer side in the fin height direction to a site in the exhaust passage 111 adjacent to the tube inner surface along which exhaust air flows at a low speed since the segment 221 is provided with the two protruding portions 224. Moreover, as shown by a solid line in FIG. 8, a swirl flow flowing from a downstream end of the protruding portion 224 toward the downstream side in the flow direction is caused in the exhaust air flowing in the exhaust passage 111 by providing the two protruding portions 224 in the segment 221. As a result, the same effects as the first embodiment can be obtained.

Moreover, according to the present embodiment, the main flow of the exhaust air flowing at a high speed in the exhaust passage 111 is guided to the segment 221 located on the downstream side of the protruding portion 224 in the flow direction along the inclined surface 225 located on an inner side of the protruding portion 224 in the fin height direction, as shown by a one-dot line in FIG. 8. The uncombusted material thereby can be prevented from depositing in the upstream end portion of the segment 221 in the flow direction, the segment 221 located on the downstream side of the protruding portion 224 in the flow direction.

Fourth Embodiment

A fourth embodiment will be described hereafter referring to FIG. 9 and FIG. 10. The fourth embodiment is different from the first embodiment in a point that the segment 221 is provided with more than one of the protruding portions 224.

Figure 9:
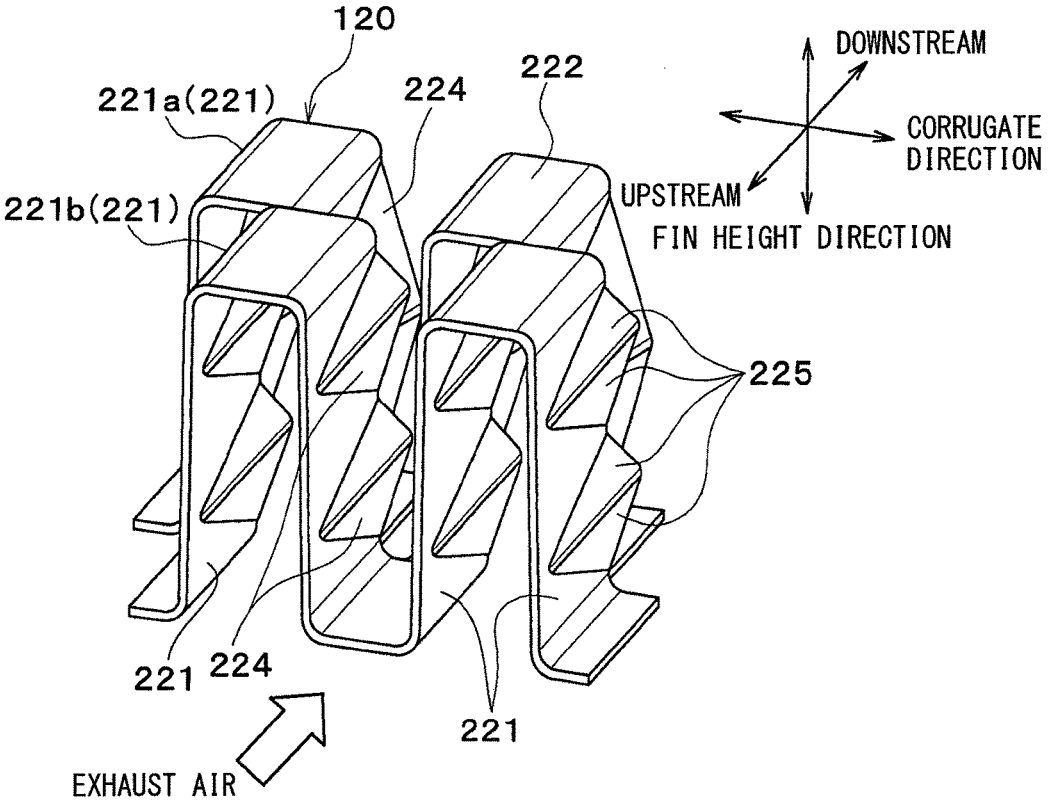
FIG. 9 is a perspective view illustrating a fin according to a fourth embodiment.
Figure 10:
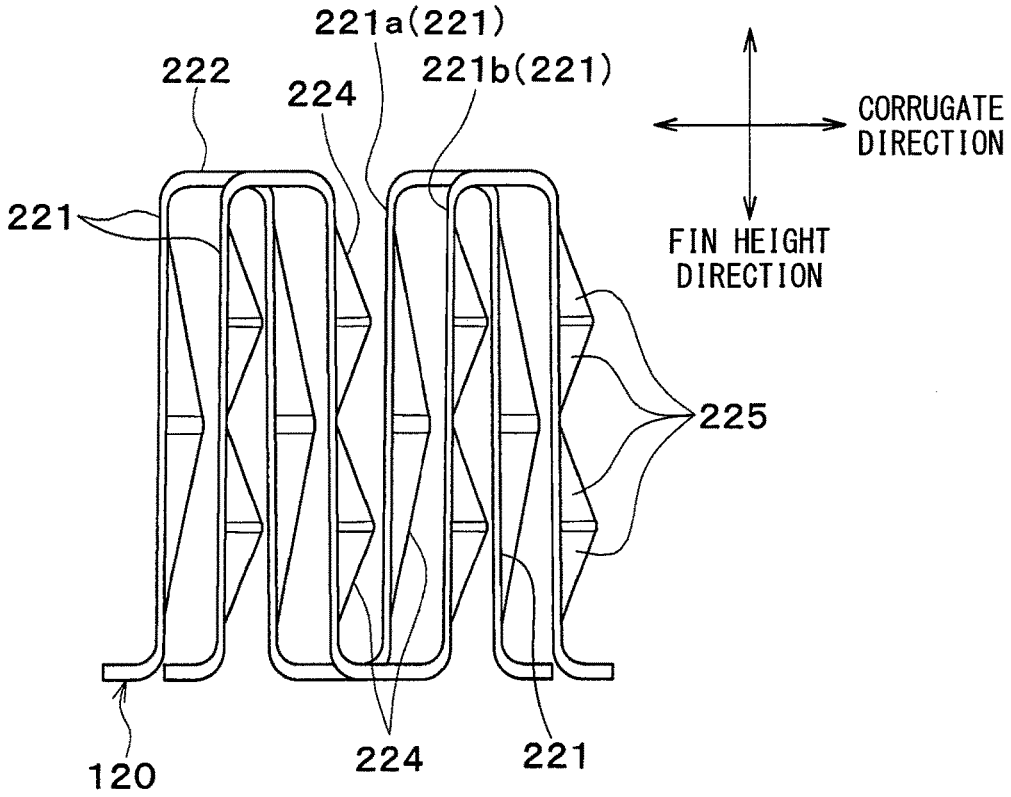
FIG. 10 is a front view illustrating the fin when viewed in a flow direction of exhaust air according to the fourth embodiment.

As shown in FIG. 9 and FIG. 10, the fin 120 has a first segment (i.e., a first plate portion) 221*a* and a second segment (i.e., a second plate portion) 221*b*. The first segment 221*a* is provided with single protruding portion 224. The second segment 221*b* is provided with more than one (e.g., two according to the present embodiment) of the protruding portions 224 arranged in the fin height direction.

As shown in FIG. 9, the first segment 221*a* and the second segment 221*b* are arranged alternately in the flow direction. In addition, as shown in FIG. 10, the first segment 221*a* and the second segment 221*b* are arranged alternately in the corrugate direction in a planar view when viewed in the flow direction.

According to the present embodiment, the first segment 221*a* and the second segment 221*b* are arranged alternately in the flow direction. As a result, both of an effect suppressing a deposit of the uncombusted material by the first segment 221*a* provided with the single protruding portion 224 and an effect suppressing a deposit of the uncombusted material by the second segment 221*b* provided with the two protruding portions 224 can be acquired.

Other Modifications

It should be understood that the present disclosure is not limited to the above-described embodiments and intended to cover various modification within a scope of the present disclosure as described hereafter. Technical features disclosed in the above-described embodiments may be combined as required in a feasible range.

Figure 11:
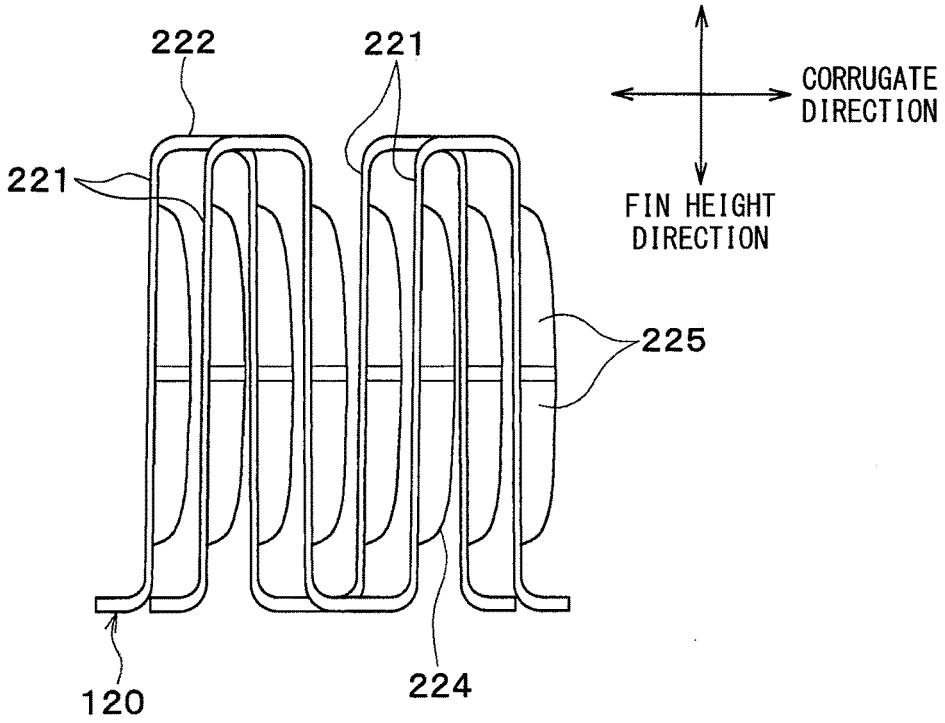
FIG. 11 is a front view illustrating a fin when viewed in a flow direction of exhaust air according to a modification.
Figure 12:
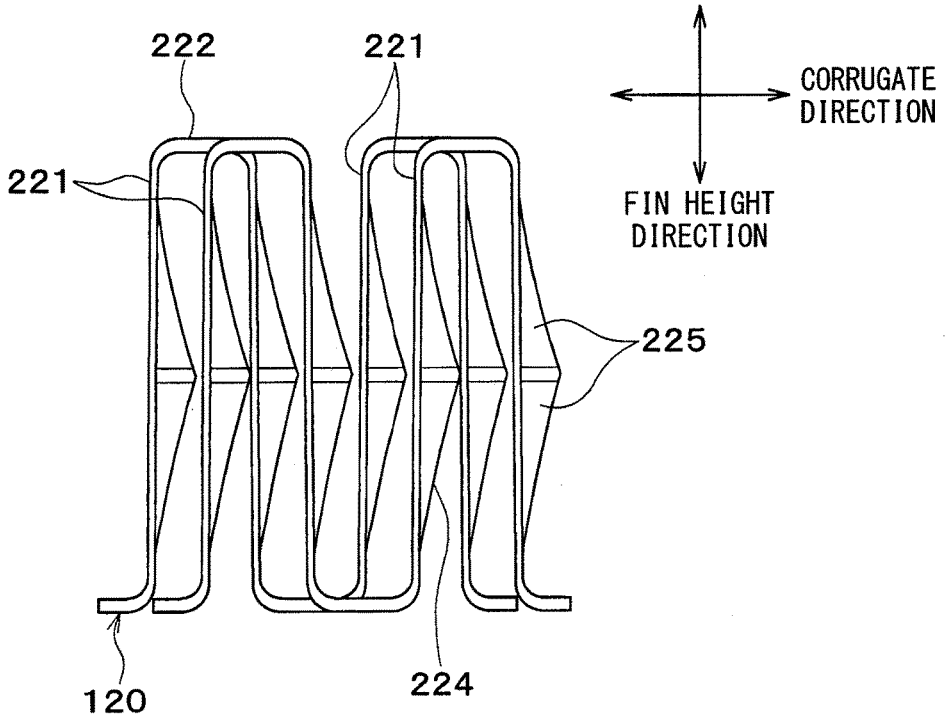
FIG. 12 is a front view illustrating a fin when viewed in a flow direction of exhaust air according to a modification.

(1) According to the above-described embodiments, the protruding amount of the protruding portion 224 from the segment 221 increases toward the center portion of the protruding portion 224 in the fin height direction. However, the protruding amount of the protruding portion 224 from the segment 221 may increase, for example, in a quadratic curve toward the center portion of the protruding portion 224 in the fin height direction as shown in FIG. 11 and FIG. 12.

Figure 13:
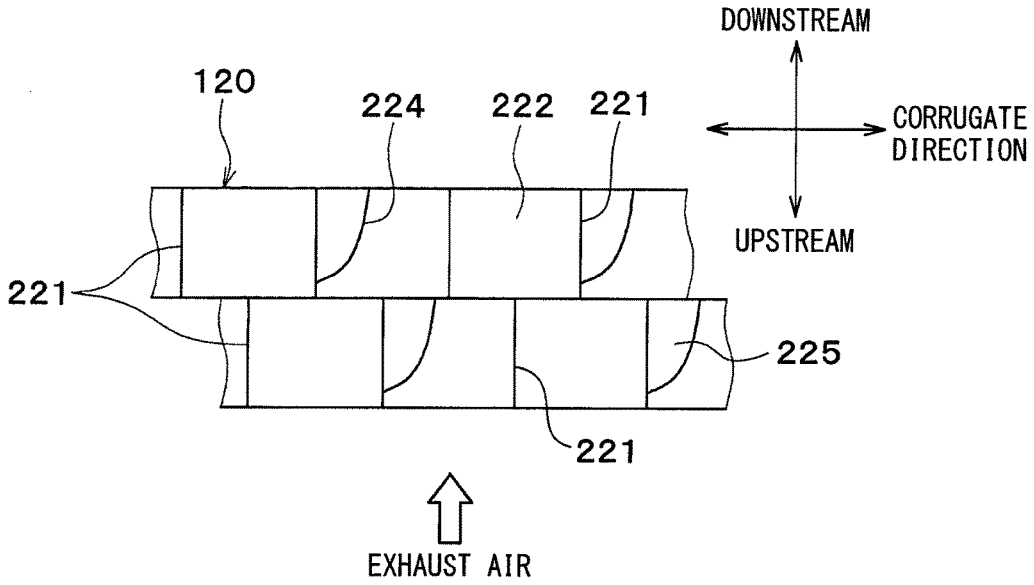
FIG. 13 is a planar view illustrating a fin when viewed in a fin height direction according to a modification.
Figure 14:
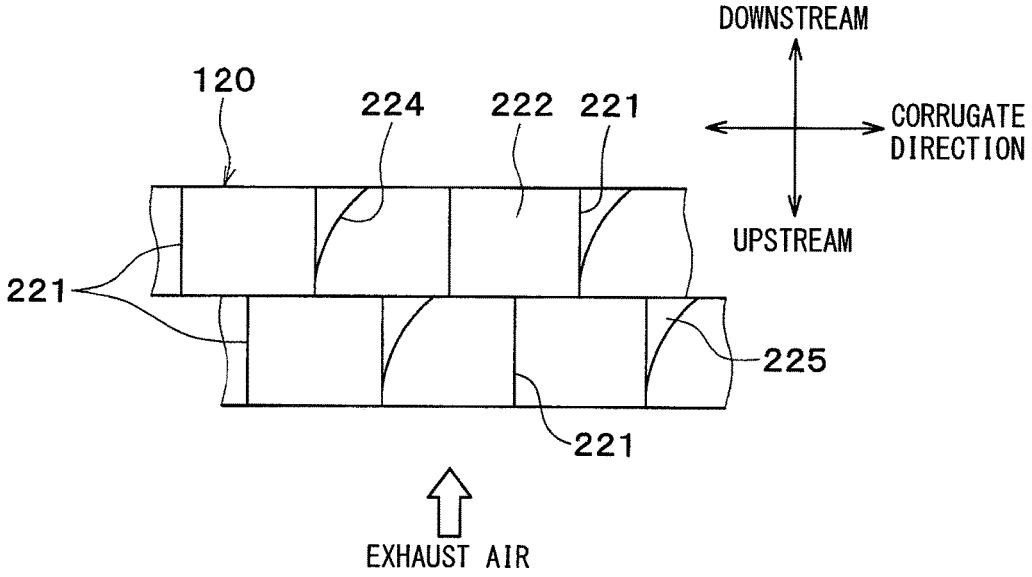
FIG. 14 is a planar view illustrating a fin when viewed in a fin height direction according to a modification.

(2) According to the above-described embodiments, the protruding amount of the protruding portion 224 from the segment 221 increases linearly from the upstream side to the downstream side in the flow direction. However, the protruding amount of the protruding portion 224 from the segment 221 may increase, for example, in a quadratic curve from the upstream side to the downstream side in the flow direction as shown in FIG. 13 and FIG. 14.

(3) According to the third embodiment, the segment 221 is provided with the two protruding portions 224. However, three or more of the protruding portions 224 may be provided. Similarly, three or more of the protruding portions 224 may be provided in the second segment 221*b* of the segment 221, although the second segment 221*b* is provided with the two protruding portions 224 according to the fourth embodiment.

(4) According to the fourth embodiment, the fin 120 has the first segments 221*a* and the second segments 221*b* that are arranged alternately with each other. However, the first segments 221*a* and the second segments 221*b* are not limited to be arranged alternately, and may be arranged arbitrarily.

What is claimed is:

1. An exhaust heat exchanger that has an exhaust passage in which exhaust air exhausted from an internal combustion engine flows in a flow direction from an upstream side to a downstream side, the exhaust heat exchanger that performs a heat exchange between the exhaust air and a cooling medium flowing outside of the exhaust passage, the exhaust heat exchanger comprising a first corrugated fin and a second corrugated fin that are disposed in the exhaust passage, wherein the first and second corrugated fins each have a longitudinal direction perpendicular to the flow direction and face each other in the flow direction, the first corrugated fin includes a plurality of first plate portions each extending along a fin height direction perpendicular to both the longitudinal direction and the flow direction, the second corrugated fin includes a plurality of second plate portions each extending along the fin height direction, the plurality of first plate portions and the plurality of second plate portions are arranged alternately with each other when viewed in the flow direction, the plurality of first plate portions and the plurality of second plate portions each include a protruding portion that protrudes from respective one of the plurality of first and second plate portions along the longitudinal direction, when (i) a direction perpendicular to both the flow direction and the direction perpendicular to the flow direction is defined as the fin height direction, (ii) a site of the protruding portion located on a downstream side of a first site of the protruding portion in the flow direction is defined as a second site, and (iii) a site of the protruding portion located away from a center portion of the protruding portion more than a third site of the protruding portion in the fin height direction is defined as a fourth site, in the exhaust passage:

a protruding amount of the protruding portion from the plate portions in the second site is larger than a protruding amount of the protruding portion from the plate portions in the first site; and a protruding amount of the protruding portion from the plate portions in the third site is larger than a protruding amount of the protruding portion from the plate portions in the fourth site, and the protruding portion has a slit extending along the center portion.

2. The exhaust heat exchanger according to claim 1, wherein the protruding amount of the protruding portion from the plate portions increases from the upstream side toward the downstream side in the flow direction and increases toward the center portion of the protruding portion in the fin height direction.

3. The exhaust heat exchanger according to claim 1, wherein the plate portions respectively have more than one of the protruding portions, and the more than one of the protruding portions are arranged in the fin height direction.

4. The exhaust heat exchanger according to claim 1, wherein the plurality of first plate portions include the protruding portion; and the plurality of second plate portions include more than one of the protruding portion arranged in the fin height direction.

5. The exhaust heat exchanger according to claim 4, wherein the plurality of first plate portions and the plurality of second plate portions are arranged to be adjacent to each other in the direction perpendicular to the flow direction.

6. An exhaust heat exchanger that has an exhaust passage in which exhaust air exhausted from an internal combustion engine flows in a flow direction from an upstream side to a downstream side, the exhaust heat exchanger that performs a heat exchange between the exhaust air and a cooling medium flowing outside of the exhaust passage, the exhaust heat exchanger comprising a first corrugated fin and a second corrugated fin that are disposed in the exhaust passage, wherein the first and second corrugated fins each have a longitudinal direction perpendicular to the flow direction and face each other in the flow direction, the first corrugated fin includes a plurality of first plate portions each extending along a fin height direction perpendicular to both the longitudinal direction and the flow direction, the second corrugated fin includes a plurality of second plate portions each extending along the fin height direction, the plurality of first plate portions and the plurality of second plate portions are arranged alternately with each other when viewed in the flow direction, the plurality of first plate portions and the plurality of second plate portions each include a protruding portion that protrudes from respective one of the plurality of first and second plate portions along the longitudinal direction, a protruding amount of the protruding portion from the plate portions increases from the upstream side toward the downstream side in the flow direction and increases toward a center portion of the protruding portion in a fin height direction, when the fin height direction is defined as a direction perpendicular to both the flow direction and the direction perpendicular to the flow direction in the exhaust passage, and the protruding portion has a slit extending along the center portion.

* * * * *